United States Patent [19]

Kesselring

[11] 3,964,489

[45] June 22, 1976

[54] SOOTHING TEAT

[75] Inventor: Lutz Kesselring, Zeven, Germany

[73] Assignee: MAPA GmbH, Hannover, Germany

[22] Filed: Sept. 6, 1974

[21] Appl. No.: 503,866

[30] Foreign Application Priority Data

Sept. 27, 1973 Germany ..... 2348562

[52] U.S. Cl. ..... 128/360

[51] Int. Cl.[2] ..... A61J 17/00

[58] Field of Search ..... 128/360

[56] References Cited

UNITED STATES PATENTS

| | | | |
|---|---|---|---|
| 954,066 | 4/1910 | Ware | 128/360 |
| 1,467,904 | 9/1923 | McOmish | 128/360 |

FOREIGN PATENTS OR APPLICATIONS

| | | | |
|---|---|---|---|
| 530,266 | 7/1954 | Belgium | 128/360 |
| 6,656 | 1895 | United Kingdom | 128/360 |

OTHER PUBLICATIONS

Advertisement of the Nuk Sauger Program, IN Amer. Jour. Orthodontics, 47[8]: Insert after p. 22, Aug. 1961.

*Primary Examiner*—Channing L. Pace
*Attorney, Agent, or Firm*—Toren, McGeady and Stanger

[57] ABSTRACT

A soothing teat consisting of a resilient teat nipple, a relatively rigid clamp member, a mouth-plate and an optional holding element wherein the clamp member is of an unique configuration with a plurality of positioning protrusions, and a neck portion of the teat nipple includes a correspondingly arranged and matingly shaped plurality of positioning ridges, the positioning protrusions and ridges adapted to interconnect the teat nipple, the clamp member and the mouth-plate.

4 Claims, 9 Drawing Figures

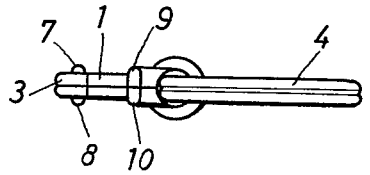
Fig.1
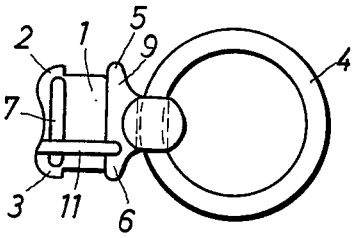
Fig.2
Fig.3
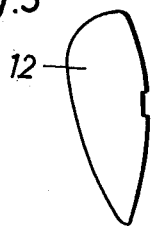
Fig.4
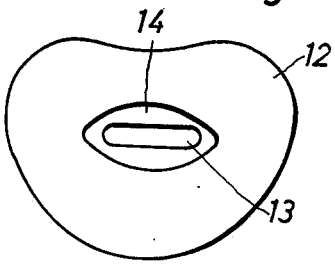
Fig.5
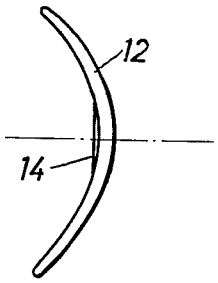

SOOTHING TEAT

The present invention relates to a soothing teat for infants of the type comprising a teat nipple, a clamp member and a mouth-plate or shield. The teat nipple is made of a resilient material such as rubber and includes a mouthpieces portion and an integral neck portion. The clamp member serves to mount the neck portion of the teat nipple and toward this end the cross-sectional configuration of the clamp member is adapted to the configuration of the neck portion of the teat nipple. The clamp member includes a pair of lugs at its free end facing the mouthpiece portion of the teat nipple. The neck portion of the teat nipple includes a pair of interiorly concave vaulting ridges. In the assembled condition, each vaulting ridge straddles a corresponding lug of the clamp member. The mouth-plate or shield is adapted to be mounted on the neck portion of the teat nipple intermediate the pair of vaulting ridges and an annular bead disposed at the free end of the neck portion.

In a prior art soothing teat of the above type as shown for example in the British patent No. 188,844 the vaulting ridge of the teat nipple neck portion consists of an enlarged neck portion that may be seated on an annular projecting head of a mounting member. This mounting member is substantially cylindrical and may be threadedly connected to another element. In the assembled condition, the annular bead at the neck of the test nipple freely engages a substantially cylindrical shaft of the mounting member.

In this prior art soothing teat the radius of curvature of the enlarged neck portion of the teat nipple greatly exceeds the size of the projecting head of the mounting member. Therefore the teat nipple may slide along the mounting member so that there is not ensured a perfect seating of the teat nipple on the mounting member. Furthermore, the latter cannot be secured in a well-defined position on the mounting member, due to the excess clearance for the mouth-plate, and there cannot be maintained a precisely defined spacing between the mouth-plate and the mouthpiece.

In soothing teats especially when used on small infants, however, this spacing is very important because the mouthpiece is precisely adapted to the infant's orthopaedic jaw bone configuration, and the postion of the mouthpiece inside the infant's mouth must be positively predetermined. Additionally it must be prevented that the mouthpiece may be inserted too far into the mouth, in order to avoid coughing irritations.

It has also been proposed to provide a mounting member in the form of a clamp of a flat configuration corresponding to the cross-section of a teat nipple neck portion disposed behind the mouthpiece. This mounting member may include lugs at its free end facing the teat nipple and at its opposite end facing a holding member such as a ring. These lugs may extend at least along the narrow side walls of the mounting member within a zone in which is disposed the end of the teat nipple and in which is retained a slip-on mouth-plate whereby the clamp is provided with longitudinal recesses extending parallel to the longitudinal axis of the teat nipple.

The present invention is directed especially to a soothing teat of this last-mentioned type. These prior art soothing teats have performed quite well. The mouth-plate which is substantially oval-shaped is curved toward the mouthpiece.

Generally, soothing teats are employed over extended periods of time and have to be boiled out periodically for sanitary reasons. In practice it has been found that in normal usage the neck of the teat nipple tends to become brittle and develop fissures especially in the area of the lugs at the free end of the clamp member. This deterioration may be observed likewise especially in prior art soothing teats of the first above-mentioned type, and is mainly due to the displaceability of the teat nipple with respect to the mounting member head resulting in fulling effects because of the clearance between the enlarged neck portion and the mounting member head. These effects interfere with the serviceability of the soothing teat and ultimately render the soothing teat unserviceable.

In prior art soothing teats there is also the risk that saliva flowing along the teat nipple neck portion penetrates through the slot of the mouth-plate and reaches the holding element, especially when exerting a rather high pulling force at the holding element.

The end of the teat nipple neck portion must be fitted onto the clamp member in a manner so that the end of the neck portion will be disposed intermediate the outwardly projecting lugs, and then the mouth-plate may be slided onto the neck portion by means of its central slot aperture which is of a predetermined oversize with respect to the clamp member cross-section.

It is now the object of the present invention to provide a novel and improved soothing teat.

It is another object of the present invention to provide a soothing teat adapted to be coupled to the clamp member so as to always assume a well-defined predetermined position thereon notwithstanding the presence of an annular bead at the end of the neck portion of the teat nipple, and without having recourse to special attachment means.

It is another object of the present invention to provide a soothing teat of the type specified above in which is eliminated any risk of damaging the neck portion of the teat nipple when coupling the same to the clamp member, and in which is positively avoided any effluent of saliva through the slot aperture in the mouth-plate or shield.

In accordance with the present invention, these objects are achieved by the fact that the clamp member comprises a body of a substantially flat parallelepiped configuration, the lugs extending at least from the narrow side walls of the clamp member, the vaulting ridges on the neck portion of the teat nipple mating the configuration of these lugs being adapted to serve as alignment means for positioning the mouthpiece portion with respect to the clamp member and for retaining the mouth-plate or shield at a predetermined spacing from the mouthpiece portion of the teat nipple.

In a more specified embodiment in which the clamp member additionally includes protrusions extending from the longitudinal side wall of the clamp member body in the vicinity of the lugs the neck portion of the teat nipple includes likewise additional interiorly concave vaulting ridges mating the configuration of the protrusions extending from the longitudinal side walls of the clamp member body whereby these additional vaulting ridges are arranged in regions that are disposed along a line interconnecting the first-mentioned vaulting ridges at the wider longitudinal side walls of the neck portion. With this design, the seating properties of the teat nipple on the clamp member are further improved and there is simultaneously provided a seal along the longitudinal sides of the slot aperture in the mouth-plate. The mouth-plate is virtually provided with sealing beads disposed in front of the slot aperture on the mouth-plate side facing the mouthpiece.

In accordance with a preferred embodiment the clamp member includes a pair of shoulders spaced from the ridge-shaped protrusions known per se along the longitudinal side walls at the free end of the clamp member body in a manner so that the ends of the slot aperture in the curved mouth-plate or shield engage the lugs substantially at the free end of the clamp member body, and the central portions of the slot aperture at the shield surface remote from the free end of the clamp member are biased into engagement with the pair of shoulders along the longitudinal side walls intermediate the lateral lugs associated with the shoulders and arranged at the free end of a holding element coupled to the clamp member. In this embodiment, the vaulting ridges are urged against the mouth-plate and the latter is positively retained, in further improving the positioning and the sealing of the mouth-plate.

In a further embodiment, each of the ridge-shaped protrusions and of the shoulders along the longitudinal side walls of the clamp member and the mating vaulting ridges on the teat nipple neck portion may be arcuately shaped with a curvature corresponding substantially to the curvature of the mouth-plate or shield. This expedient ensures an uniform bearing engagement along the whole length of the slot aperture in the mouth-plate.

In the following, the invention will be explained more in detail with reference to the illustrated embodiments shown in the appended drawings wherein FIG. 1 is a lateral elevation of a clamp member in combination with a holding element in the form of a ring;

FIG. 2 is a top view of FIG. 1;

FIG. 3 is a lateral elevation of a mouth-plate or shield;

FIG. 4 is an elevational view of FIG. 3 as seen from the left hand side thereof;

FIG. 5 is a top view of FIG. 3;

The components of the soothing teat illustrated in FIGS. 1–5 are conventional. In all of the FIGURES of the drawings, similar or equivalent components are indicated by the same reference numerals.

Figure 9:
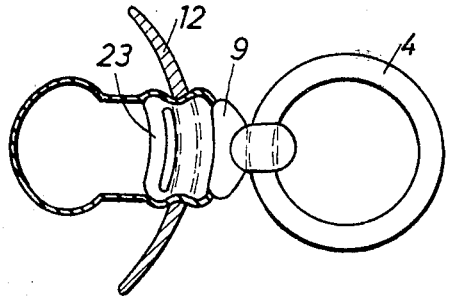
FIG. 9 is a top view as in FIG. 8 of another embodiment of a soothing teat in accordance with the present invention.

Referring first to FIGS. 1 and 2, there is shown a clamp member 1 having projecting lugs 2 and 3 at its free end along the narrow side walls, and another pair of projecting lugs 5 and 6 along the narrow side walls at the end of the clamp member facing a holding element 4 in the form of a ring. As may best be seen from FIG. 1, the lugs 2 and 3 are interconnected along the longitudinal side walls at the upper and the lower surfaces by ridge-shaped protrusions 7, 8, and the lugs 5 and 6 are similarly interconnected by an upper and a lower shoulder 9, 10 respectively. As shown in FIG. 2, one or several recesses may extend in the longitudinal direction of the clamp member and serve the purpose of ventilating the teat nipple. In FIG. 2 is illustrated one such recess 11 for ventilating the teat nipple.

As may be seen from FIGS. 3–5, the mouth-plate or shield 12 is oval-shaped and curved in two directions. Substantially centrally of the mouth-plate 12 is provided a slot aperture 13 by means of which the mouth-plate may be slid onto the clamp member 1 so that the slot aperture 13 will be positioned intermediate the first pair of lugs 2, 3 and the second pair of lugs 5, 6. At its concave side, the mouth-plate may be provided with a reinforcing backing 14 surrounding the slot aperture 13. Preferably the mouth-plate has the overall shape of a kidney.

Figure 6:
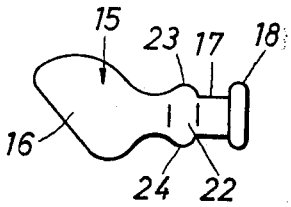
FIG. 6 is a lateral elevation of a first embodiment of a teat nipple in accordance with the present invention.
Figure 7:
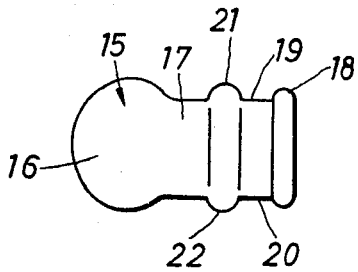
FIG. 7 is a top view of FIG. 6.

Referring to FIGS. 6 and 7, the teat nipple 15 includes a mouthpiece portion 16 of conventional configuration and an integral neck portion 17 having an outwardly projecting annular bead 18 around its open end. In accordance with the present invention, a pair of outwardly projecting interiorly concave vaulting ridges 21, 22 are provided at least along the narrow side walls 19, 20 of the teat nipple neck portion 17. The vaulting ridges 21, 22 are of a mating configuration with respect to the lugs 2, 3 and will automatically overlap in a straddling manner the lugs 2, 3 when sliding the neck portion 17 of the teat nipple onto the clamp member 1. In this manner, the vaulting ridges will automatically provide for the correct positioning of the teat nipple 15 with respect to the clamp member 1.

The teat nipple neck portion 17 further includes, along the wider side walls of the neck portion, in a line connecting the vaulting ridges 21, 22, another pair of transversely projecting vaulting ridges 23, 24. These vaulting ridges 23, 24 are matingly shaped with respect to the ridge-shaped protrusions 7, 8 respectively of the clamp member 1 and will be brought into an overlapping position with respect to these protrusions 7, 8 when sliding the teat nipple neck portion 17 onto the clamp member 1.

Figure 8:
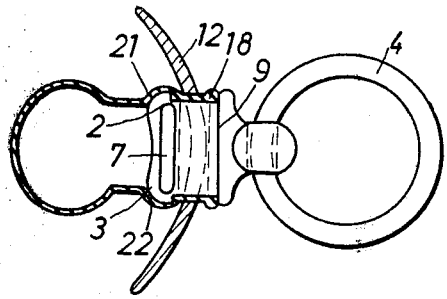
FIG. 8 is a top view of an embodiment of a soothing teat in accordance with the present invention, partly in cross-section.

FIG. 8 illustrates a first embodiment of an assembled soothing teat in accordance with the present invention. As may be seen from this FIG. 8, the spacing between the ridge-shaped protrusions 7, 8 and the shoulders 9, 10 on the clamp member 1 is selected with respect to the curvature of the mouth-plate or shield 12 in a manner so that the edges of the slot aperture 13 in the mouth-plate 12 will be urged against the vaulting ridges 21, 22, and on the opposite side the mouth-plate 12 abuts in a central region of its slot aperture 13 the annular bead 18 of the teat nipple, in resiliently compressing this annular bead. Therefore the mouth-plate 12 will be supported by the shoulders 9, 10 of the clamp member 1 and is perfectly sealed against the teat nipple as well as positively retained in a resilient manner between the vaulting ridges.

As illustrated in the further embodiment shown in FIG. 9, the engagement between mouth-plate or shield 12 and teat nipple 15 may be still further enhanced by arcuately shaping the ridge-shaped protrussions 7, 8 and the associated overlapping vaulting ridges 23, 24 as well as the shoulders 9, 10 whereby the curvature substantially corresponds to the curvature of the mouth-plate or shield 12.

The embodiments of the invention in which an exclusive property or privilege is claimed are defined as follows:

1. A soothing teat comprising a teat nipple made of a resilient material such as rubber, the teat nipple including a mouthpiece portion and an integral hollow shaped neck portion having a free end spaced from the mouthpiece portion with an annular bead extending around the free end; a clamp member fitted into and mounting the neck portion of the teat nipple, said clamp member having a first end and a second end with the first end located within the neck portion, the clamp member having a cross-sectional configuration conforming to the shaped neck portion of the teat nipple, the clamp member having a pair of outwardly projecting spaced lugs at its first end, the neck portion of the teat nipple including a pair of spaced interiorly concave first vaulting ridges; a curved mouth-plate mounted on said neck porton of the teat nipple intermediate said pair of first vaulting ridges and said annular bead at the free end of said neck portion wherein the said neck portion of said teat nipple having a pair of narrow side walls and a pair of longitudinal side walls extending between said narrow side walls and said clamp member comprises a body of a substantially flat parallelepiped configuration having a pair of narrow side walls and a pair of longitudinal side walls extending between said narrow side walls, said longitudinal side walls of said neck portion and of said clamp member being wider than the narrow side walls thereof, the lugs extending at least from the narrow side walls of the clamp member body, the interior surfaces of said first vaulting ridges on the neck portion of the teat nipple mating with said lugs and defining attachment and alignment means for mounting the neck portion of the teat nipple on the clamp member and thus positioning the mouthpiece portion with respect to the clamp member and for retaining the mouth-plate or shield at a predetermined spacing from the mouthpiece portion of the teat nipple, the clamp member further includes outwardly extending ridge shaped protrusions from the longitudinal side walls of the clamp member body in the vicinity of the lugs at the first end of said clamp member, and the neck portion of the teat nipple includes a pair of spaced interiorly concave second vaulting ridges mating with the protrusions on the longitudinal side walls of the clamp member body, the second vaulting ridges located along a line interconnecting the first vaulting ridges and positioned on the wider longitudinal side walls of the neck portions.

2. A soothing teat as in claim 1, wherein the clamp member includes a pair of shoulders on the second end of said clamp member spaced from said ridge-shaped protrusions along the longitudinal side walls at the first end of the clamp member body, said curved mouth plate having a slot aperture with a pair of spaced ends with the ends of the slot aperture in engagement with the lugs of the clamp member body, and the central portions of the slot aperture between the ends thereof at the surface of the mouth plate remote from the first end of the clamp member are biased into engagement with the pair of shoulders along the longitudinal side walls of said clamp member, and a pair of lateral lugs extending outwardly from the narrow side walls of said clamp member at the second end thereof, and a holding element coupled to the second end of said clamp member.

3. A soothing teat as in claim 2, wherein each of the ridge-shaped protrusions and of the shoulders along the longitudinal side walls of the clamp member and of the mating vaulting ridges on the teat nipple neck portion are arcuately shaped in the planes of the longitudinal side walls thereof, and the arcuate shapes thereof corresponding substantially to the curvature of the mouth-plate or shield

4. A soothing teat as in claim 1, wherein the clamp member includes at least one recess formed in the surface thereof and extending in the longitudinal direction of the clamp member between the first and second ends thereof and serving of ventilate the teat nipple.

* * * * *